US007179989B2

(12) United States Patent
Sterkers et al.

(10) Patent No.: US 7,179,989 B2
(45) Date of Patent: Feb. 20, 2007

(54) DEVICE FOR LOCATING ELECTRIC CONDUCTOR CABLES

(75) Inventors: Renaud Sterkers, Lyons (FR); Ariel Ruiz, Villeurbanne (FR)

(73) Assignee: ABB Entrelec, Villeurbanne (FR)

( * ) Notice: Subject to any disclaimer, the term of this patent is extended or adjusted under 35 U.S.C. 154(b) by 0 days.

(21) Appl. No.: 10/514,882

(22) PCT Filed: Jun. 5, 2003

(86) PCT No.: PCT/FR03/01690

§ 371 (c)(1),
(2), (4) Date: Aug. 11, 2005

(87) PCT Pub. No.: WO2004/003941

PCT Pub. Date: Jan. 8, 2004

(65) Prior Publication Data

US 2006/0086527 A1 Apr. 27, 2006

(30) Foreign Application Priority Data

Jun. 28, 2002 (FR) ..... 02 08150
Aug. 6, 2002 (FR) ..... 02 09992

(51) Int. Cl.
*H01B 7/29* (2006.01)

(52) U.S. Cl. ..... 174/36

(58) Field of Classification Search ..... 174/36, 174/DIG. 8

See application file for complete search history.

(56) References Cited

U.S. PATENT DOCUMENTS

| | | | | |
|---|---|---|---|---|
| 3,212,207 | A | 10/1965 | Searing | |
| 3,312,250 | A * | 4/1967 | Sirignano et al. | 138/128 |
| 3,474,559 | A | 10/1969 | Hunt | |
| 4,199,884 | A * | 4/1980 | Loof | 40/316 |
| 4,361,230 | A * | 11/1982 | Downing et al. | 206/345 |
| 4,425,174 | A * | 1/1984 | McLoughlin | 156/218 |
| 4,442,939 | A * | 4/1984 | Downing | 206/345 |
| 4,488,642 | A | 12/1984 | Changani et al. | |
| 4,586,610 | A * | 5/1986 | Gandolfo | 206/485 |
| 4,862,922 | A * | 9/1989 | Kite, III | 138/119 |
| 4,865,895 | A * | 9/1989 | Vlamings et al. | 428/98 |
| 4,908,177 | A * | 3/1990 | Hartner | 264/132 |
| 5,564,571 | A * | 10/1996 | Zanotti | 206/716 |
| 5,766,705 | A * | 6/1998 | O'Brien et al. | 428/34.9 |
| 6,282,353 | B1 * | 8/2001 | Clark | 385/99 |
| 6,485,199 | B1 * | 11/2002 | Ware et al. | 385/99 |
| 2005/0056113 | A1 * | 3/2005 | Bovid | 74/502.5 |

* cited by examiner

*Primary Examiner*—William H. Mayo, III
(74) *Attorney, Agent, or Firm*—Oliff & Berridge, PLC

(57) ABSTRACT

A device for locating electric conductor cables that includes a sleeve designed to engage at least one end of a cable. The outer surface of the sleeve includes marks for identifying the cable concerned. The sleeve is flattened, and a section of the sleeve is closed over only a part of the length of the sleeve and at least part of the width of said sleeve, an unclosed part delimiting a passage for the cable.

12 Claims, 3 Drawing Sheets

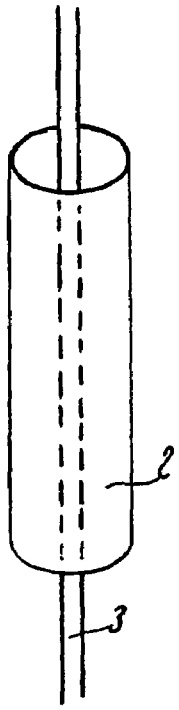
FIG 1
(Related Art)
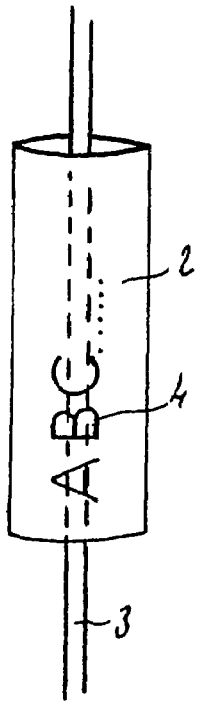
FIG 2
(Related Art)
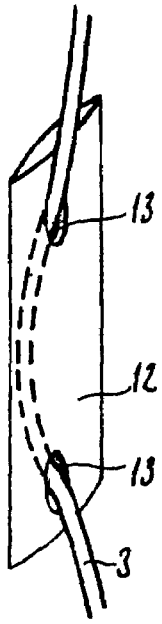
FIG 3
(Related Art)
FIG 4
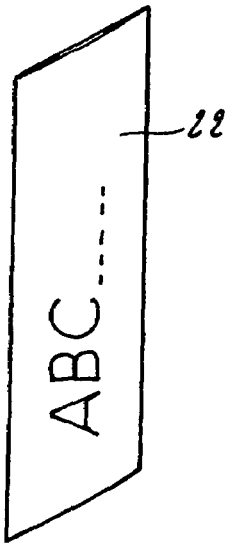
FIG 5
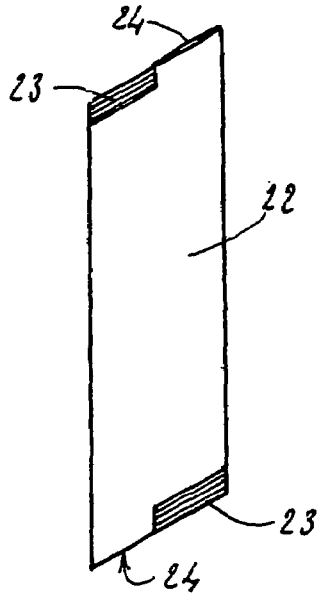

DEVICE FOR LOCATING ELECTRIC CONDUCTOR CABLES

BACKGROUND

The object of the present invention is a device for locating electric conductor cables.

The term cable covers an outer sheathing containing several conductors as well as just a single wire.

In some applications, and in particular in the rail sector, whether it concerns trains, tramways or subways, it is necessary to locate the conductor cables using an external device, to facilitate the connection of the cables, on first connection, but also on reconnection, for example after changing a device powered by these cables.

Each cable is located by a sleeve made of heat-shrinkable synthetic material, bearing identification marks on its outer surface. Theoretically, the sleeve is fitted around the cable to be located, from one end of the latter, and then is heat-shrunk onto the cable, in order to be immobilized on it.

In practice, for reasons of economy, manufacturers are eliminating the heat-shrinking operation. In effect, given the cable is connected through the intermediary of a terminal fitting placed on the end of the cable, and representing an enlargement of the cable, the terminal fitting can secure the sleeve.

However, the arrival on the market of new types of connections, for example spring connections without an end fitting, and insulation displacement connections, raises the problem of securing the sleeve on the cable, in a maintenance operation, if the sleeve is not heat-shrunk onto the cable.

FIG. 1 of the schematic drawing appended represents a known device, comprising a sleeve 2 of synthetic heat-shrinkable material, fitted on a conductor cable 3. The outer surface of the sleeve includes identification marks 4. As shown in FIG. 2, after the sleeve is fitted on the cable, the sleeve is heat-shrunk and flattened, ensuring that it is fixed on the cable.

To try to avoid the loss of a sleeve that is not heat-shrunk onto a conductor cable, a sleeve 12 was devised, as shown in FIG. 3, with two through-holes 13, enabling the cable 3 to pass from one side of the flattened sleeve to the other, through a first hole, and then to pass from this other side to the first side through the second hole. One drawback of this solution is that, when the sleeve is flattened, the conductor cable covers one side of the sleeve, preventing the identification marks applied to that side from being read.

SUMMARY

The technical issue on which the invention is based is therefore to provide a device for locating an electric conductor cable, using a sleeve, which can be secured on the cable without any ancillary fixing device or any heat-shrinking operation needing to be performed on application, and which can be fitted on the cable simply and quickly.

To this end, the device to which it relates, of the type comprising a sleeve designed to be fitted on a cable and whereof the outer surface includes marks identifying the cable concerned, the sleeve being flattened, is mainly characterized in that a section of the sleeve is closed over at least a part of the width of said sleeve, the unclosed part delimiting a passage for the cable.

Preferably, the sleeve is closed at at least one of its ends, over a part of its width, the unclosed part delimiting a slot for the passage of the cable.

Advantageously, at least one end of the sleeve is closed over a part of its width by adhesive bonding or welding, or by heat-shrinking, by heating a part of this end or even a section of the sleeve located at any point over the length of this sleeve.

The or each slot provided at one or both ends of the sleeve allows the cable to be inserted into and directed out of the sleeve. The or each closure area of the sleeve creates on the cable sufficient pressure to secure it on the cable in the event of any cable disconnection. The length of each slot is proportional to the diameter of the cable to be fitted to ensure good pressure from the sleeve on the cable. It should be noted that, given that the sleeve is flattened, this arrangement leaves both sides of the sleeve visible, so that the identification marks applied to the sleeve can easily be read.

According to a first embodiment, the two ends of the sleeve are closed over a part of their width.

The fact of having two slots at both ends of the sleeve ensures that the sleeve is well secured on the cable.

According to one option, at least one of the two slots, provided at the two ends of the sleeve, is adjacent a corner.

Advantageously in this case, the two slots, provided at the two ends of the sleeve, are adjacent two opposite corners.

This configuration is interesting because, when the cable is fitted in the sleeve, in other words, introduced into the sleeve through one of the slots at one end, it is easy to find the slot from which the cable exits from the sleeve, given that it is located at a corner.

To facilitate this operation, each closure area at one end of the sleeve is delimited, on the inside of the sleeve, by an angled line making an angle of about 45° with the respectively lengthwise and widthwise edges of the sleeve that it links. This structure prevents the cable from catching in a corner, since the angled line naturally guides the end of the cable towards the slot provided in the end of the sleeve concerned.

According to another option, a slot for the passage of the cable, provided at one end of the sleeve, is located roughly midway between the two corners delimiting this end of the sleeve.

According to one embodiment, in this latter case, the two slots, provided at the two ends of the sleeve, are located roughly midway between the corners delimiting the two ends of the sleeve.

It is, however, possible to combine various arrangements described above.

Thus, in particular, it is possible to provide one slot in the central part of one end and the other slot in an area adjacent a corner of the other end.

Advantageously, this sleeve is made of heat-shrinkable plastic, and the closure areas of the ends are obtained by heat-welding. It is, however, possible to consider the use of other materials, including cardboard with a partial closure of one or both ends by adhesive bonding.

In any case, the invention will be clearly understood from the description that follows, with reference to the appended schematic drawing representing, by way of nonlimiting examples, various embodiments of this device.

BRIEF DESCRIPTION OF DRAWING

FIGS. 1 to 3 are views of known devices.

FIG. 4 is a view of a sleeve open at both ends.

FIG. 5 is a view of the sleeve in FIG. 4 after partial closure of these two ends.

DETAILED DESCRIPTION OF EMBODIMENTS

FIG. 4 represents a sleeve 22 forming the device according to the invention.

Figure 6:
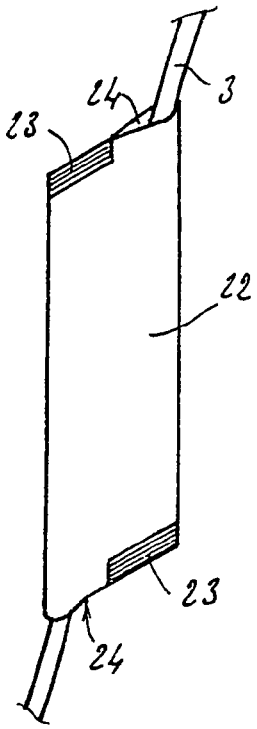
FIG. 6 is a view of the device in FIG. 5 after fitting on a cable.

In the embodiment represented in FIGS. 5 and 6, the two ends of this sleeve of synthetic material are partially closed by two heat-welded areas 23, each area 23 extending from one corner of the sleeve 22, previously flattened. The two closed areas 23 are arranged offset relative to each other. Each end of the sleeve 22 comprises, in the extension of a closed area 23, a slot 24 extending to the other corner.

As shown in FIG. 6, the cable 3 is fed into in one of the slots 24 at one end of the sleeve and exits from the sleeve through the slot 24 provided at the other end of the sleeve, this second slot being adjacent the opposite corner of the sleeve. The pressure created on the cable 3 is enough to secure the sleeve on it, without requiring heat shrinking or the presence of an additional fixing device.

Figure 7:
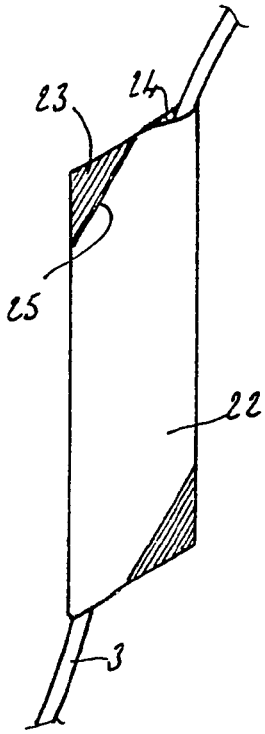
FIG. 7 is a view similar to FIG. 6 of a variant of the device in FIG. 6.
Figure 8:
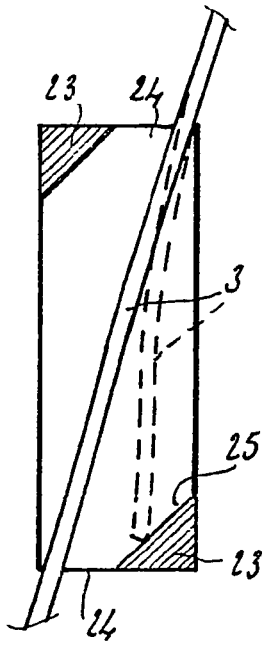
FIG. 8 is a longitudinal cut-away view of the device in FIG. 7.

In the embodiment represented in FIGS. 7 and 8, the same elements are designated by the same references as before. In this case, the thermoweld 23 is not applied in a line at right angles to the center line of the sleeve, but is triangular in shape, with a line 25 located on the inside of the sleeve, making an angle of approximately 45° with the two respectively lengthwise and widthwise edges of the sleeve.

As shown by broken lines in FIG. 8 this arrangement avoids the risk that the end of the cable 3, when inserted into the sleeve, will catch in a corner of the latter. In practice, the line 25 naturally guides the end of the cable 3 towards the exit slot 24.

Figure 9:
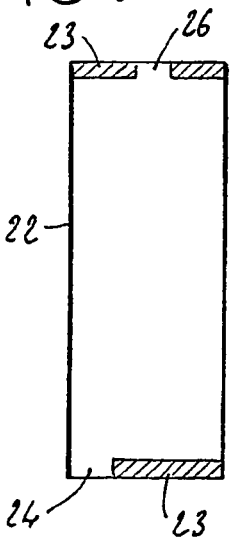
FIG. 9 to 11 are views similar to FIG. 8 representing three other embodiments of this device.

FIG. 9 is a variant in which a slot 26 is provided roughly midway between the two corners of an edge of the sleeve, while the slot 24, associated with the other edge, is adjacent a corner.

Figure 10:
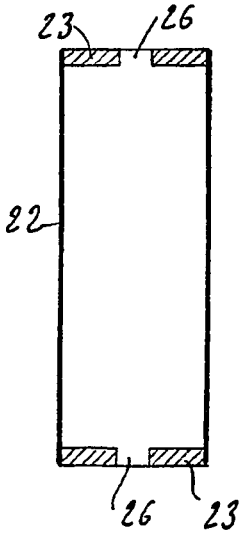

FIG. 10 represents a variant in which the two slots 26, provided in both ends of the sleeve, are each located roughly midway between the corners of the ends concerned.

Figure 11:
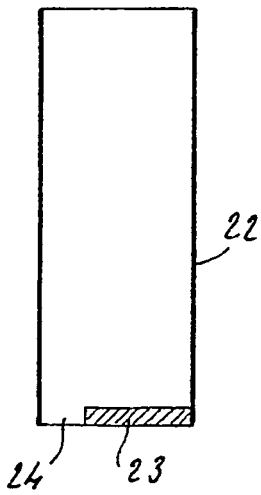

FIG. 11 represents another variant of this device, in which one end of the sleeve is totally open, and the other end is closed by an area 23 with a slot 24 provided adjacent a corner.

Figure 12:
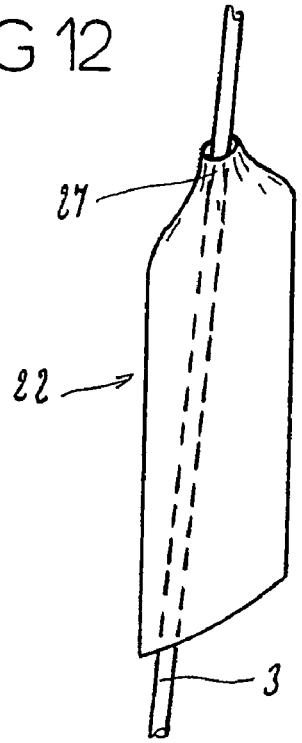
FIG. 12 is a view of a sleeve made of heat-shrinkable material with one of its ends shrunk.

FIG. 12 represents a variant of the device according to the invention. In this variant, the sleeve is made of a film or a sheet of a heat-shrinkable material. One end of the sleeve is shrunk by blowing hot air between two guides designed to limit the shrinkage area 27, while keeping the body of the sleeve intact.

Figure 13:
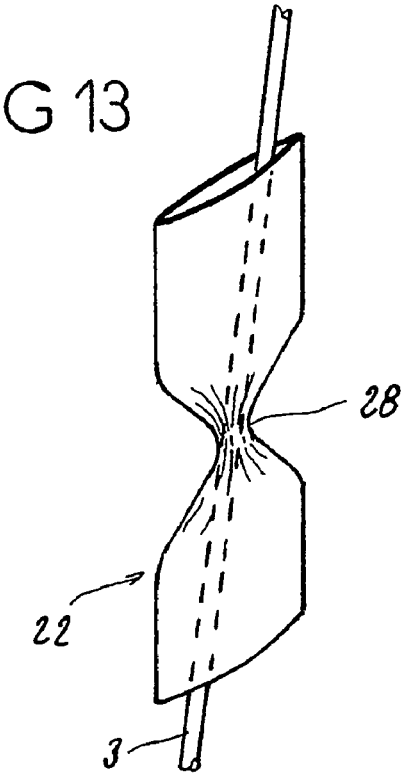
FIG. 13 is a view of a sleeve made of heat-shrinkable material which is shrunk, not at one of its ends, but over a section taken from a part of its length.

FIG. 13 represents another variant of the device according to the invention. In this variant, the sleeve is made as previously, of a film or sheet of a heat-shrinkable material. This time, the sleeve 22 is shrunk over a part of its length. The shrinkage area 28 is thus no longer located at one end of the sleeve, but at any point taken over the length of the sleeve. The area 28 is again obtained by blowing hot air between two guides designed to limit its length relative to that of the sleeve, thus keeping the rest of the body of this sleeve intact. The two ends of the sleeve are therefore totally open.

As can be seen from the above, the invention adds a great improvement to the existing technique, by providing a device for locating conductor cables, of a simple structure, secured on the cable with no ancillary device and with no specific fixing operation, such as heat-shrinking, while leaving all of the outer surface of the sleeve visible.

Obviously, the invention is not limited solely to the embodiments of this device described above by way of examples, but rather encompasses all variants thereof. Thus, in particular, the material forming the sleeve might not be a synthetic material, but another material such as cardboard, with partial closure of at least one end of the sleeve, for example by adhesive bonding, without in any way departing from the scope of the invention, or even the closed areas and the slots described could be combined differently without in any way departing from the scope of the invention.

The invention claimed is:

1. A device for locating electric conductor cables, comprising a sleeve designed to be fitted on a cable and an outer surface of the sleeve including marks identifying the cable concerned, the sleeve being flattened, wherein a section of the sleeve is closed over only a part of the length of the sleeve and at least a part of the width of the sleeve, an unclosed part delimiting a passage for the cable.

2. The device as claimed in claim 1, wherein the sleeve is closed at at least one of its ends, over a part of its width, the unclosed part delimiting a slot for the passage of the cable.

3. The device as claimed in claim 2, wherein at least one end of the sleeve is closed over a part of its width by adhesive bonding or welding.

4. The device as claimed in claim 2, wherein the sleeve is made of a film or sheet of heat-shrinkable material, and at least one of the ends of the sleeve is shrunk over a part of its width by heat-shrinking.

5. The device as claimed in claim 4, wherein two slots, provided at the two ends of the sleeve, are located roughly midway between the corners delimiting the two ends of the sleeve.

6. The device as claimed in claim 1, wherein the sleeve is made of a film or sheet of heat-shrinkable material, and the sleeve includes an area shrunk by heat-shrinking located at any point over the length of the sleeve.

7. The device as claimed in claim 1, wherein two ends of the sleeve are closed over a part of their width.

8. The device as claimed in claim 7, wherein at least one slot, provided at the two ends of the sleeve, is adjacent a corner.

9. The device as claimed in claim 8, wherein two slots, provided at the two ends of the sleeve, are adjacent two opposite corners.

10. The device as claimed in claim 7, wherein each closure area, at one end of the two ends of the sleeve, is delimited on the inside of the sleeve by an angled line making an angle of about 45° with the respectively lengthwise and widthwise edges of the sleeve.

11. The device as claimed in claim 1, wherein a slot for the passage of the cable, provided at one end of the sleeve, is located roughly midway between the two corners delimiting the one end of the sleeve.

12. The device as claimed in claim 1, wherein the sleeve is made of synthetic material.

* * * * *